US005954942A

United States Patent [19]

Adornato et al.

[11] Patent Number: 5,954,942

[45] Date of Patent: Sep. 21, 1999

[54] CATALYTIC CRACKING WITH DELAYED QUENCH

[75] Inventors: Peter M. Adornato, Cherry Hill, N.J.; Amos A. Avidan, Yardley; David L. Johnson, Glen Mills, both of Pa.

[73] Assignee: Mobil Oil Corporation, Fairfax, Va.

[21] Appl. No.: 07/877,913

[22] Filed: May 4, 1992

[51] Int. Cl.[6] ..... C10G 9/16

[52] U.S. Cl. ..... 208/48 Q; 208/113; 208/100; 208/103; 208/153; 208/127; 208/48 R

[58] Field of Search ..... 208/120, 489, 208/48 Q, 100, 103, 113, 127, 153

[56] References Cited

U.S. PATENT DOCUMENTS

| | | | |
|---|---|---|---|
| 3,758,403 | 9/1973 | Rosinski et al. | 208/120 |
| 4,218,306 | 8/1980 | Gross et al. | 208/120 |
| 4,356,338 | 10/1982 | Young | 585/407 |
| 4,764,268 | 8/1988 | Lane | 208/160 |
| 4,786,400 | 11/1988 | Farnsworth | 208/164 |
| 4,804,459 | 2/1989 | Bartholic et al. | 208/177 |
| 4,818,372 | 4/1989 | Mauleon et al. | 208/113 |
| 4,978,440 | 12/1990 | Krambect et al. | 208/48 Q |
| 5,019,239 | 5/1991 | Owen | 208/100 |
| 5,043,058 | 8/1991 | Forgac et al. | 208/48 |
| 5,073,249 | 12/1991 | Owen | 208/48 Q |
| 5,087,349 | 2/1992 | Goelzer et al. | 208/113 |

FOREIGN PATENT DOCUMENTS 9355089 7/1993 Spain .

OTHER PUBLICATIONS

Modeling Revamps of Riser Reactors of the FCCUS: by J. Corella Dept. Aiche Spain pp. 110–115 No. 291 vol. 85.

*Primary Examiner*—Helane Myers

*Attorney, Agent, or Firm*—Robert B. Furr, Jr.; Malcolm D. Keen

[57] ABSTRACT

A process for thermally and catalytically upgrading a heavy feed in a single riser reactor FCC unit is disclosed. A heavy feed is cracked in the base of the riser at higher than normal cracking temperatures for at least 1.0 seconds of vapor residence time, then quenched. Quenching with large amounts of quench, preferably downstream of the mid point of the riser, increases conversion as compared to use of the same amount of quench within one second. Small amounts of quench, near the riser outlet, crack heavy feed roughly as well as large amounts of quench, near the base of the riser. High velocity, atomizing quench nozzles reduce riser pressure and/or catalyst slip in downstream portions of the riser, further increasing gasoline selectivity and reducing coke yields.

5 Claims, 2 Drawing Sheets

CATALYTIC CRACKING WITH DELAYED QUENCH

FIELD OF INVENTION

This invention relates to methods of cracking hydrocarbon feedstocks in the presence of a cracking catalyst.

BACKGROUND OF THE INVENTION

Processes for cracking hydrocarbon feeds with hot regenerated fluidized catalytic particles are known generically as "fluid catalytic cracking" (FCC).

Distilled feeds such as gas oils are preferred feeds for FCC. Such feeds contain few metal contaminants and make less coke during cracking than heavier feeds. However, the higher cost of distilled feeds provides great incentive to use heavier feeds, e.g., residual oils, as feed in FCC. Resids generally contain more metals, which poison the catalyst and an abundance of coke precursors, asphaltenes and polynuclear aromatics, which end up as coke on catalyst rather than cracked product. Resids are also hard to vaporize in FCC units. FCC operators are well aware of the great difficulty of cracking resids and of the profit potential, because these heavy feeds are much cheaper than distilled feeds.

Most FCC operators that crack resid simply blend in a small amount of resid, on the order of 5 or 10 wt %, with the distilled feed. This blending of different feeds, and addition of the blended feed to the base of the riser, is the way most refiners operate, but some units operate with split feeds, i.e., cracking different kinds of feed at different elevations in an FCC riser.

U.S. Pat. No. 4,422,925-Williams et al. taught an FCC process with a light feed fed to the base of a riser, and a worse feed, having a higher tendency to form coke, charged higher up the riser.

U.S. Pat. No. 4,218,306-Gross et al., having a common assignee with the present invention and incorporated by reference, taught cracking gas oils in a lower part of a riser then cracking a more difficult feed, such as a coker gas oil, in an upper section of the riser.

Blending, or split feeds with a heavier feed added higher up in the riser, are not completely satisfactory when the feed contains large amounts of resid or asphaltenics which are difficult to vaporize quickly in the base of a riser reactor.

Most units cracking resids stay with the blended feed approach and try to improve the process by using relatively large amounts of atomizing steam. Thus while conventional FCC units, cracking wholly distillable feeds, might add 1 or 2 wt % steam with the heavy feed to improve atomization, those units cracking heavier, more viscous feeds add significantly more steam, 3, 4, or 5 wt % steam, or even more. While increased atomization steam usually improves cracking efficiency, it also substantially increases the load on the main column, and limits primary feed throughput. Steam reduces hydrocarbon partial pressure, which is beneficial, but increases overall pressure, which increases operating costs. The increased steam usage associated with cracking resids also produces large amounts of sour water which is a disposal problem.

Some units have tried to deal with residual feeds by charging the resid containing feed to the base of the riser, cracking it momentarily at an unusually high temperature, then quenching with a heat sink such as water or a lower boiling cycle oil higher up in the riser. The higher temperatures were believed sufficient to thermally shock asphaltenes into smaller molecules which could then be cracked catalytically. Thus U.S. Pat. No. 4,818,372, taught the advantages of quenching quickly, with an auxiliary fluid within one second and preferably in less than half a second. The '372 process would improve the cracking of residual feeds but caused some problems.

The '372 process used large amounts of quench, either large amounts of water or even larger amounts of a recycled fluid such as a cycle oil. Water quench increases plant pressure and sour water production, much as does increased use of atomizing steam. LCO or HCO quench does not create as severe a pressure problem as water, because of smaller molar volume, but there is some loss of riser cracking capacity and a significantly increased load on the main column.

We realized that although large amounts of quench increased conversion of heavy stock, the large amounts of quench had offsetting side effects.

We conducted experiments and ran computer model studies to try to determine more accurately what was happening in the riser, and to learn more precisely why riser quenching led to improved cracking of resid containing stocks, with a view to developing a better process.

We discovered that cracking of heavy chargestocks in a riser reactor could be completely characterized by considering only thermal and catalytic reactions.

Based on our understanding of what went on in the riser, we made computer simulations of various quench scenarios, and discovered that quick quenching was not preferred, and that quenching after 1 second, and preferably after about 2 seconds of vapor residence time, gave improved results.

Our simulations showed that while quenching within one second is good, delayed quench was even better. Thus quenching within 0.5 seconds of vapor residence time increased gasoline yields, but quenching at 1.5 seconds made gasoline yields better still. Delaying quenching until after 2.0 seconds of vapor residence time further improved gasoline yields.

The capital and operating expenses associated with quenching somewhat higher up in the riser, after 1.5 or 2.0 seconds, are essentially nil. The improved gasoline yields are, however, significant.

We found that the conventional teachings on riser quench could be ignored. We could use an unconventional amount of quench (less than normal) in an unconventional place (higher up in the riser) and get results essentially equivalent to those using larger amounts of quench within 1.0 seconds of vapor residence time. We could get the benefits of quenching, while minimizing the unpleasant side effects of the conventional approach to quenching.

Using another approach, we found that using conventional amounts of quench in an unconventional place (higher in the riser) gave increased conversion of fresh feed and increased gasoline selectivity.

We also found a way to let the energy contained in the quench stream perform useful work in reducing riser pressure. We could add large volumes of steam to a riser in a way which would increase riser pressure only slightly or even decrease riser pressure. This reduced pressure, or lesser increase in pressure from steam addition translates into increased plant capacity and/or increased gasoline selectivity.

BRIEF SUMMARY OF THE INVENTION

The present invention provides a catalytic cracking process wherein a heavy feed comprising non-distillable hydrocarbons is catalytically cracked in a riser reaction zone, operating at riser cracking conditions including a riser vapor residence time, by contact with a source of hot, regenerated cracking catalyst to produce catalytically cracked vapors and spent cracking catalyst, cracked vapors are withdrawn as products, and spent cracking catalyst is regenerated in a catalyst regeneration means to produce hot regenerated cracking catalyst which is recycled to contact said heavy feed, the improvement comprising:cracking in the base of a vertical riser reactor having a length, for at least 1 second of vapor residence time and for at least the first 50% of the length of the riser reactor from the base, a heavy feed containing at least 10 wt % non-distillable hydrocarbons by contact with hot regenerated cracking catalyst at a cat:feed weight ratio of a least 4:1 and wherein the amount and temperature of the hot regenerated catalyst are sufficient to produce a catalyst/heavy feed mixture temperature sufficient to promote both catalytic cracking and undesired thermal cracking of said heavy feed in said riser; and quenching, after at least 1 second of vapor residence time, said catalyst mixture in a quench zone within said riser reactor by injecting, within the first 90% of the length of the riser reactor from the base, an inert quench fluid in an amount sufficient to quench the temperature in the riser at least 5° F.

In another embodiment, the present invention provides a method of increasing gasoline yields during riser catalytic cracking comprising: adding to the base of a riser cracking reactor a preheated, heavy hydrocarbon feed comprising 650° F.+hydrocarbons and a supply of hot regenerated cracking catalyst, to form a mixture of feed and catalyst having a mix temperature above about 1020° F. and sufficient to vaporize said feed and promote catalytic cracking and undesired thermal cracking reactions; cracking, at high temperature, catalytic cracking conditions, said feed for at least 1.0 seconds of vapor residence time to produce catalyst having a reduced catalytic activity and partially cracked products having a temperature sufficient to cause undesired thermal reactions; quenching said high temperature intermediate product in a quench zone by injecting an inert quench fluid in an amount sufficient to quench the temperature in the riser at least 7.5° F.; quenched cracking of said quenched intermediate product for a vapor residence time of at least 0.1 seconds, and wherein the post quench vapor residence time in said riser reactor is less than the vapor residence time in said high temperature cracking zone; discharging from said riser reactor a mixture of cracked vapors comprising gasoline boiling range hydrocarbons and spent catalyst and separating to form a cracked vapor phase and a spent catalyst phase; stripping said spent catalyst to produce stripped catalyst; regenerating said stripped catalyst to produce a supply of hot regenerated catalyst and recycling said hot regenerated catalyst to said cracking reactor; and fractionating said cracked vapor phase to produce a gasoline boiling range product fraction, and wherein said gasoline product fraction is larger in volume than a gasoline product fraction obtainable when an identical amount of quench fluid is charged to said cracking reactor within about 1.0 seconds in said high temperature cracking zone upstream of quench injection.

In a more limited embodiment, the present invention provides a method of increasing gasoline yields by riser catalytic cracking and delayed quenching of a feedstock containing at least 10 wt % hydrocarbons boiling above 932° F. comprising: adding to the base of a riser cracking reactor a preheated, heavy hydrocarbon feed comprising 650° F.+hydrocarbons and containing at least 10 wt % hydrocarbons boiling above 932° F. and a supply of hot regenerated cracking catalyst, to form a mixture of feed and catalyst having a mix temperature above about 1020° F. and sufficient to promote catalytic cracking and undesired thermal cracking reactions and cracking said feed in a high temperature cracking zone for at least 2.0 seconds of vapor residence time to produce a high temperature intermediate cracked product; quenching said high temperature intermediate product from said high temperature cracking zone, in a quench zone in said riser reactor downstream of said high temperature cracking zone, by injecting water, steam, or hydrocarbons boiling below the gas oil range or mixtures thereof, in an amount sufficient to quench the temperature in the riser less than 18° F.; cracking said quenched intermediate product in a quenched riser cracking zone for a vapor residence time of at least 0.1 seconds, and for a vapor residence time less than the vapor residence time in said high temperature cracking zone to produce a mixture of cracked vapors comprising gasoline boiling range hydrocarbons and spent catalyst; discharging said mixture from said riser reactor and separating to form a cracked vapor phase and a spent catalyst phase; stripping said spent catalyst to produce stripped catalyst; regenerating said stripped catalyst to produce a supply of hot regenerated catalyst and recycling said hot regenerated catalyst to said cracking reactor; fractionating said cracked vapors to produce a gasoline boiling range product fraction; and wherein said gasoline product fraction is larger in volume than a gasoline product fraction obtainable when an identical amount of quench fluid is charged to said cracking reactor within about 1.0 seconds in said high temperature cracking zone upstream of quench injection.

In another embodiment, the present invention provides a process for the quenched, reduced pressure, riser catalytic cracking of a heavy hydrocarbon feed to lighter products comprising adding to the base of a riser cracking reactor a feed comprising 650° F.+hydrocarbons and a supply of hot regenerated cracking catalyst, to form a mixture of feed and catalyst having a mix temperature above about 1000° F., catalytically cracking said feed at a riser base pressure of 15 to 50 psia to produce a high temperature partially cracked product and catalyst passing as dilute phase up said riser; educting said dilute phase by injecting water, steam, or hydrocarbons boiling below the gas oil range or mixtures thereof, and wherein the quench nozzles are radially distributed around the riser, and pointing toward a centerline of the riser and in the direction of the riser outlet, the pressure and amount of injected fluid, and the nozzle configuration and alignment, are sufficient to educt or aspirate the dilute phase material in the riser toward the riser outlet, and wherein the pressure in the base of the riser is at least 1.0 psi less than the pressure in the base of the riser which would be measured by injecting the same amount of fluid horizontally into the riser; discharging a mixture of cracked vapors comprising gasoline boiling range hydrocarbons and spent catalyst from said riser reactor; stripping said spent catalyst to produce stripped catalyst; regenerating said stripped catalyst to produce a supply of hot regenerated catalyst and recycling said hot regenerated catalyst to said cracking reactor; and fractionating said cracked vapors to produce a gasoline boiling range product fraction.

DESCRIPTION OF THE PREFERRED EMBODIMENTS

Figure 1:
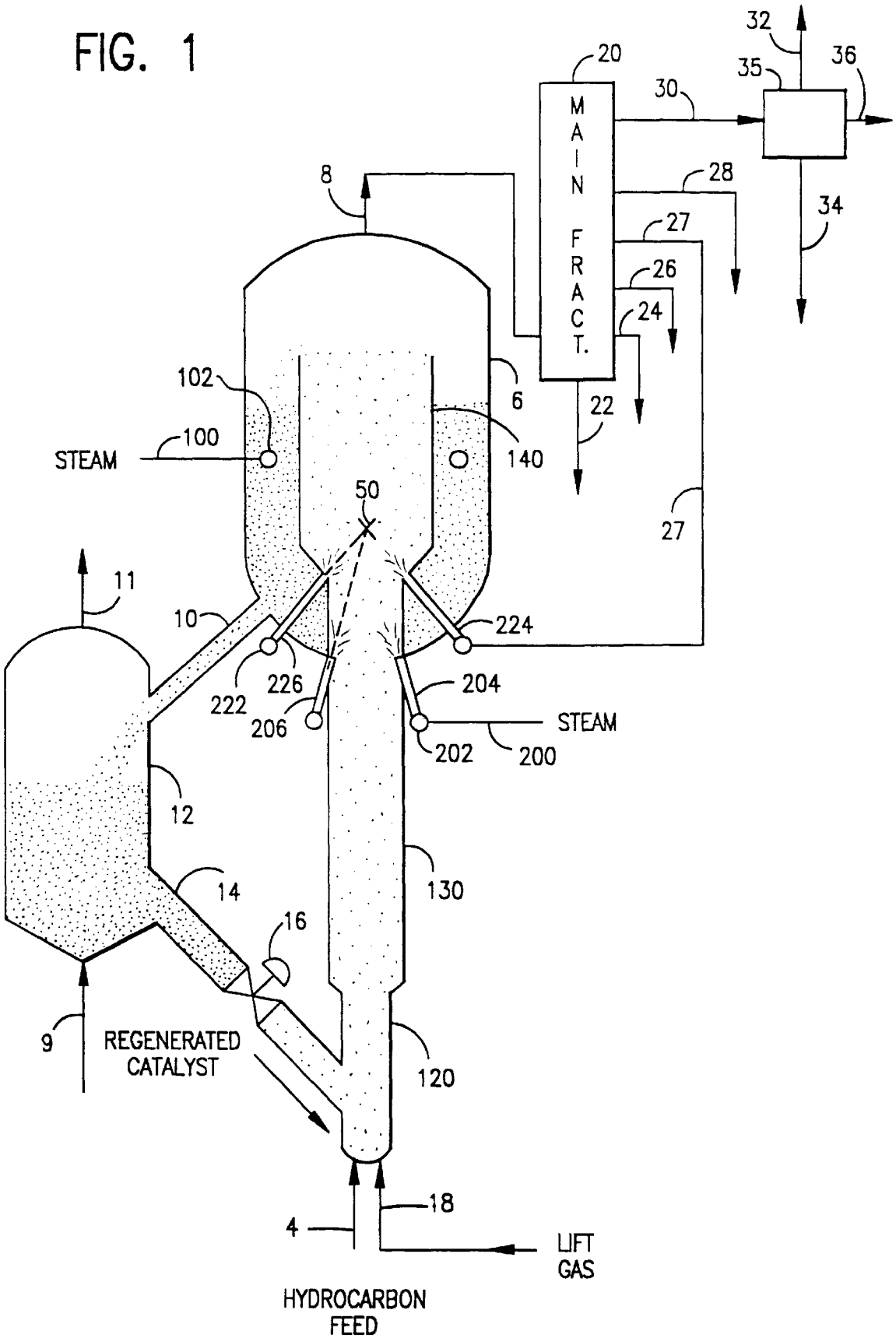
FIG. 1 is a simplified schematic of a preferred embodiment, with upper riser quench points and aspirating quench nozzles.

FIG. 1 is a schematic flow diagram of a preferred embodiment of the present invention. It is not drawn to scale.

A heavy feed is charged to the bottom of the riser reactor 120 via inlet 4. Hot regenerated catalyst is added via conduit 14 equipped with a flow control valve 16. A preferred but optional lift gas is introduced below the regenerated catalyst inlet via conduit 18. The riser reactor is an elongated, cylindrical, smooth-walled tube which periodically gets wider to accommodate volumetric expansion in the riser. Most patent drawings of FCC riser reactors show cylindrical tubes with a constant diameter, while in commercial practice most get wider. The narrowest portion of the riser is the base region 120, with the middle region 130 being wider, and the top region 140, extending into the stripper, is the widest. Such a riser configuration is conventional.

The preferred but optional lift gas, from an external source, or a recycled light end fraction from the main fractionator added via line 18, helps condition the catalyst some and smooths out the flow patterns of catalyst before catalyst meets injected feed. The feed is usually injected via 4–10 atomizing feed nozzles to contact hot regenerated catalyst, vaporize and form a dilute phase suspension with the FCC catalyst. The suspension passes up the riser, which gets wider to accommodate volumetric expansion.

Roughly ⅔ way up the riser, quenching fluid is injected via several layers of radially distributed quench nozzles. In the embodiment shown, steam from line 200 is supplied via steam distribution ring 202 to a plurality of nozzles 204, 206, and others not shown. These nozzles have a relatively narrow spray pattern and are aimed at converging point 50, roughly 1.25 riser diameters downstream of the first ring of nozzles.

A second set of nozzles quench with a recycled heavy naphtha fraction. Heavy naphtha is added via line 27 and distribution ring 222 to a plurality of nozzles 224, 226 and others not shown. The naphtha quench nozzles can be identical to those used to inject steam. Additional energy will usually be added to light liquid hydrocarbon quench streams by pumps not shown or by addition of steam, preferably moderate or high pressure steam. Preferably the converging point of nozzles is the same.

Typically, a single set of nozzles would be used, injecting a mixture of steam and hydrocarbon, which are mixed just upstream of, or in the barrel of, the nozzles.

The design shown makes effective use of much of the conventional hardware associated with riser reactors and uses it to approximate a venturi shape. Most risers have enlarged sections, but no beneficial use is made of them, and the enlargement may exacerbate undesired catalyst reflux by creating a more stagnant region just downstream of each point where the riser diameter increases. This promotes further growth of an annular ring of refluxing catalyst, which is trapped in the riser for a long time, cycling back and forth in the riser, serving no useful function and building up coke levels.

After quenching, and a limited amount of additional cracking in the upper portion of the riser 140, cracked products and coked catalyst usually pass into a solid-vapor separation means, such as a conventional cyclone, not shown. Preferably, the riser has a deflector and a short residence time stripper, as disclosed in U.S. Pat. No. 4,629,552 (Haddad and Owen) incorporated by reference. Another good design is the closed cyclone design in U.S. Pat. No. 4,749,471 (Kam et al.), incorporated by reference.

A means for stripping entrained hydrocarbons from the catalyst is usually provided in the base of vessel 6. Stripping steam is added via line 100 and steam distributor ring 102. Stripping is conventional. Most of the stripping section, and the solid-gas separation equipment, is omitted from the drawing for clarity. Cracked products are withdrawn from the reactor by conduit 8.

Stripped catalyst containing coke is withdrawn via conduit 10 and charged to regenerator 12. Catalyst flow will usually be controlled by a slide valve or other flow control means, not shown. The catalyst is regenerated by contact with an oxygen-containing gas, usually air added via line 9. Flue gas is withdrawn from the regenerator by line 11.

Usually the feed temperature is about 150° C. to 375° C. (300–700° F.). The regenerator operates at about 650° C. to 760° C. (1200–1400° F.). Some regenerators run even hotter, such as two stage regenerators, and these may be used as well in the process of the invention. The catalyst to feed weight ratio is usually about 3:1 to 10:1, adjusted as necessary to hold a reactor outlet of about 500° C. to 550° C. (932–1020° F.).

Most FCC riser reactors operate with regenerated catalyst addition set by reactor top temperature control. Addition of quench fluid reduces the riser top temperature, causing more catalyst addition to the base of the riser. The net effect of quenching will be higher temperatures at the base of the riser, and more or less conventional temperatures at the top of the riser. Other control schemes may also be used, e.g., constant addition of regenerated catalyst, with variable feed preheat to keep riser top temperature constant.

Cracked product from the FCC unit passes via line 8 to main fractionator 20, where product is separated into a heavy, slurry oil stream 22, heavy distillate 24, light distillate 26, heavy naphtha 27, light naphtha 28, and a light overhead stream 30, rich in C2–C4 olefins, C1–C4 saturates, and other light cracked gas components. In refineries using heavy naphtha quench, some may be withdrawn as a product by means not shown, with the remainder recycled for use as quench.

The light cracked gas stream is usually treated in an unsaturated gas plant 35 to recover various light gas streams, including C3–C4 LPG stream in line 36, and an optionally $C_2^-$ fuel gas or the like recovered via line 32. A light, $H_2$ rich gas stream may be recycled from the gas plant via line 34 and lines not shown for use as all, or part, of a lift gas used to contact catalyst in the base of the riser.

RISER CRACKING CONDITIONS—PRE QUENCH

The conditions in the base of the riser can be more or less conventional. The somewhat higher temperatures, and higher cat:oil ratios, taught in U.S. Pat. No. 4,818,372, which is incorporated herein by reference, for use in the base of the riser may be used herein. These conditions are very similar to conventional FCC riser cracking conditions, but about 10 to 50° F. hotter, and those skilled in the cracking arts can readily achieve such conditions.

The riser base temperature will frequently be 510 to 620° C. (950–1150° F.), preferably 535 to 595° C. (1000–1100° F.).

QUENCH

The amount of quench, assuming perfect mixing of quench with material in the riser, at the point of quench injection, should be sufficient to reduce riser temperature by at least 2.5° C. (5° F.), and preferably by 5 to 55° C. (9 to 100° F.), and most preferably by 10 to 50° F. (5.5 to 30° C.). The optimum amount of quench will vary with the quench point in the riser.

It is essential to quench after at least a second of vapor residence time in the base of the riser, and preferably after 1.5 seconds of residence time, and most preferably after 2.0 seconds of residence time. It is important, for those risers or downflow reactors having a short residence time that quench occur well before the riser outlet. We want to have some cracking at unusually severe conditions, followed by additional cracking at or below conventional riser cracking conditions. Quenching at or too near the outlet of the riser, say within ½ s of the riser outlet, will not achieve the desired result; essentially all of the cracking in the reactor will be at the overly severe conditions. This will overcrack the gasoline, and reduce gasoline yield.

Rather than refer to vapor residence time, which varies greatly from unit to unit and is difficult to calculate, quenching at the following fractional riser locations may be considered. In general for risers operating with a vapor residence time of 4 seconds or more, we believe that quenching should occur more than ¼ way up the riser, preferably more than ⅓ up the riser, and even more preferably ½ way up the riser. In many units, quenching about 50–80% of the way up the riser, or even later, will be optimum.

We believe our process works because we promote catalytic cracking in the base of the riser reactor with higher temperatures, and because we crack at higher cat/oil ratios. At first this may seem unlikely, in that the higher temperatures in the base of the riser are easily sufficient to promote classical thermal reactions such as visbreaking. These thermal reactions are of course promoted; there is no way to prevent thermal reactions from occurring. The high temperatures also promote catalytic cracking with hot, freshly regenerated catalyst, the most active catalyst in the riser.

Higher temperatures are achieved in the base of the riser because there is a higher proportion of the hotter catalyst relative to the cooler oil. This higher cat:oil ratio also enhances the rate of cracking reactions.

Another beneficial mechanism comes into play in the process of the present invention, and to some extent in the prior art quench process—namely, resistance of the acid sites of the cracking catalyst to neutralization by basic nitrogen compounds. The higher temperatures of the cracking catalyst are sufficient to desorb, or prevent adsorption of, at least a portion of the basic nitrogen compounds in the feed. Thus while higher temperatures will promote thermal reactions, the higher temperatures will also promote catalytic reactions, the cat:oil ratio will be higher than that in the absence of quench, and the catalyst will be more active as well.

QUENCH FLUIDS

Any conventional quench fluids, such as cold solids, water, steam, or inert vaporizable liquids, such as cycle oils and slurry oils, or other aromatic rich streams, may be used. All such quench fluids will remove heat. Preferably liquids are used so that more heat can be removed from a given weight of fluid added. Use of a reactive quench liquid, which promotes endothermic reactions, may be preferred in some circumstances.

The preferred quench fluids are water or water, steam, recycled heavy naphtha or light cycle oil (LCO) and mixtures thereof.

DELAYED QUENCH

While quench is essential, it is also essential not to quench too quickly.

Quenching preferably occurs only after the catalyst loses most of its initial activity due to coke formation. Catalytic cracking predominates in the base of the riser, due to the extremely active catalyst and high temperature. The catalyst deactivates rapidly, and after quenching all reactions, both thermal and catalytic, are reduced in the upper portions of the riser. Our process works well, we believe, not because we suppress thermal reactions downstream of the quench point, but because we promote catalytic reactions upstream of the quench point and quench all reactions (thermal plus catalytic) downstream of quench.

The activation energy for coking reactions is lower than that for catalytic cracking reactions. Therefore, the rate of catalytic cracking reactions is enhanced relative to coking reactions in the lower portion of the riser. This leads to an improvement in selectivity as well as an increase in severity.

Figure 2:
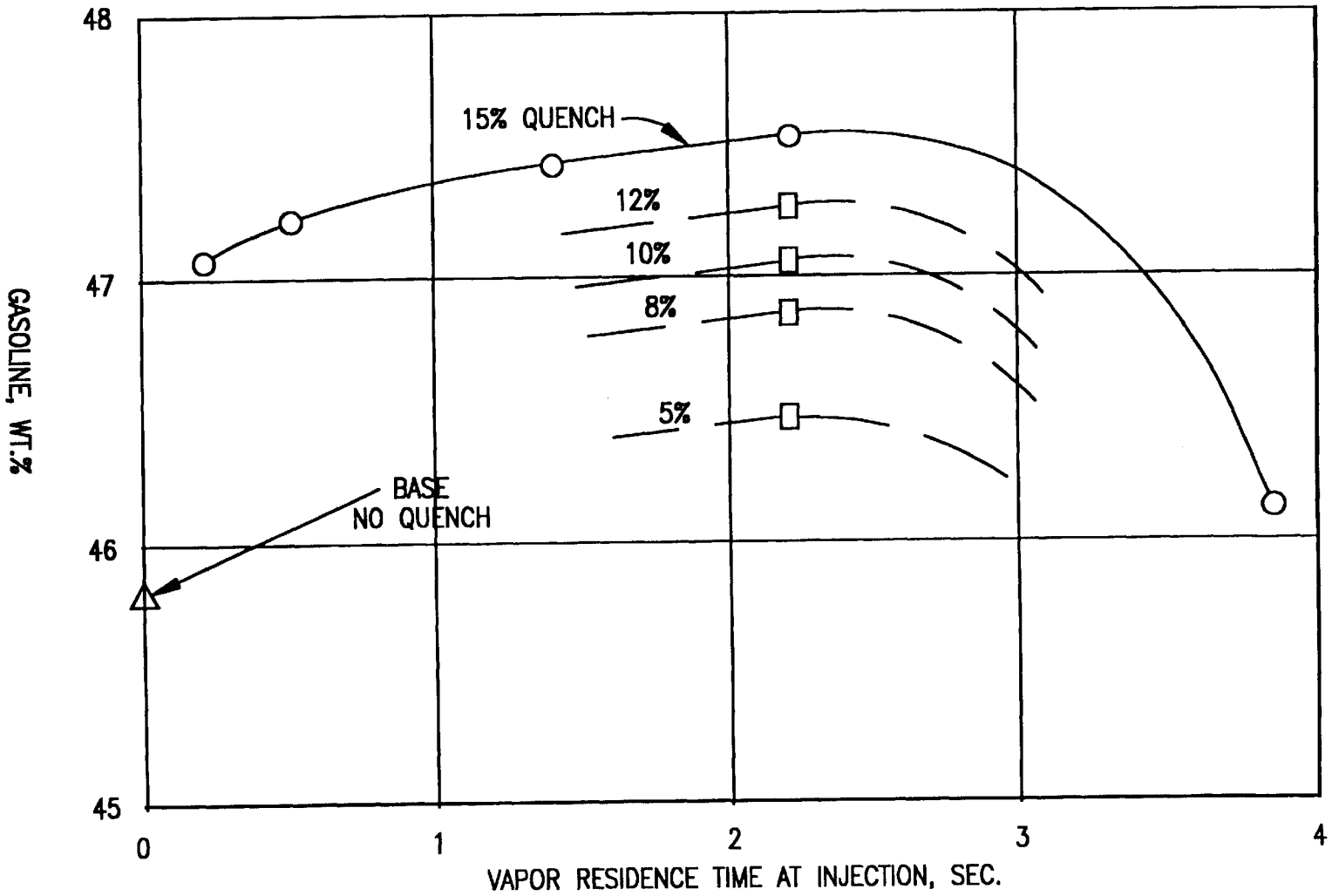
FIG. 2 shows a plot of yields versus quench points and amount.

Surprisingly, the optimum quench point rises as the amount of quench fluid drops. FIG. 2 illustrates this. At one extreme putting in less quench, later, works about as well as conventional amounts of quench within one second of vapor residence time in the riser.

The present invention can be used especially well in refineries where bottlenecks in downstream processing equipment limit the amount of quench. One examples of such a bottleneck is the main column flooding from too much heavy naphtha recycle. Another type of bottleneck occurs if the plant cannot tolerate large amounts of steam or sour water from use of water quench. For these units use of 20 to 80% of the "conventional" amount of quench, added much later in the riser, will give gasoline yields similar to those achieved with large amounts of quench near the base of the riser.

For FCC units with no restrictions on quench amount, it will be possible to significantly increase gasoline yields by using conventional amounts of quench and adding it later to the riser.

RISER TOP TEMPERATURE

Although conditions at the base of the riser are more severe than those associated with conventional FCC operations, the FCC unit at the top of the riser, and downstream of the riser, can and preferably does operate conventionally. When processing large amounts of resids, especially those which contains large amounts of reactive material which readily forms coke in process vessels and transfer lines, it may be preferable to operate with conventional or even somewhat lower than normal riser top temperatures. Riser top temperatures of 510 to 565° C. (950–1050° F.) will be satisfactory in many instances.

CATALYST ACTIVITY

Conventional FCC catalyst, i.e., the sort of equilibrium catalyst that is present in most FCC units, can be used herein. The catalyst per se forms no part of the present invention. Highly active catalysts, with high zeolite contents, are preferred. The process of the present invention will make any FCC reactor, using any conventional cracking catalyst, work better. Individual economics will determine if there is better profit potential at a refinery from working equilibrium catalyst a bit harder or going to more active catalyst.

THERMAL REACTIONS

The extended residence time in the riser, at higher temperatures, will lead to increased thermal conversion. This is good and bad. Thermal cracking of the extremely large molecules making up the bottom of the barrel is good, but thermal cracking of light ends of the feed, or re-cracking of cracked products, is bad.

ADDITIVE CATALYSTS

In many instances it will be beneficial to use one or more additive catalysts, which may either be incorporated into the conventional FCC catalyst, added to the circulating inventory in the form of separate particles of additive, or added so that the additive does not circulate with the FCC catalyst. The additives, per se, form no part of the present invention.

ZSM-5 is a preferred additive, whether used as part of the conventional FCC catalyst or as a separate additive.

SOx capture additives, available commercially, may be used to reduce the level of SOx in the regenerator flue gas. CO combustion additives, usually Pt on a support, are used by most refiners to promote CO combustion in the FCC regenerator.

FEED COMPOSITION

The present invention is applicable for use with all FCC feeds. The process can be used with distilled feeds, such as gas oils or vacuum gas oils, or heavier feeds such as resids or vacuum resids.

The feeds may be similar to those described in U.S. Pat. No. 4,818,372 and U.S. Pat. No. 4,427,537—namely, those feeds which contain at least 10 wt % material boiling above about 500° C., and preferably those which contain 20, 25, 30% or more of such high boiling material.

A mixture of resid, and conventional FCC recycle streams, such as light cycle oil, heavy cycle oil, or slurry oil, can also be used. In this instance, the FCC recycle stream acts primarily as a diluent or cutter stock whose primary purpose is to thin the resid feed to make it easier to pump and to disperse into the base of the riser reactor.

PRIOR ART

Several computer simulations of the process described in '372 (using an inert quench liquid as a heat sink, adding all the feed to the base of the riser) were made.

In all cases 3 wt % atomization steam was present, which is a typical amount of atomization steam used in many refineries.

The computer model is used internally to predict FCC operation in commercial refineries and is believed to be a reliable predictor of plant performance. The model is also more flexible and more consistent than a single test. In most operating refineries either the crude type, feed rate or product demand changes. Our model takes into account both catalytic cracking and thermal reactions.

FEED PROPERTIES

| | Nigerian VGO | Nigerian Atmospheric Resid |
|---|---|---|
| API | 20.6 | 18 |
| CCR, wt % | 1.3 | 4.3 |
| Basic N, ppm | 710 | 1340 |
| Distillation: | | |
| D1160 | | |
| 10% | 675 | 810 |
| 50% | 865 | 950 |
| 90% | 1020 | 1100 |

A: Base Case=Standard FCC operation

B: '372: 30% water quench, constant pressure, feed rate reduced as much as it would be in a commercial plant to accommodate the volume of steam produced by the water quench.

C: '372: 30% water quench, constant feed, and pressure adjusted to accommodate the volume of steam from water quench.

Feed preheat was adjusted in all cases to maintain constant coke yields.

D: '372: 15% water quench, constant pressure, feed rate reduced as much as it would be in a commercial plant to accommodate the volume of steam produced by the water quench. These were obtained by linear interpolation of Cases A and B.

YIELDS

| | CASE A | CASE B | CASE C | CASE D |
|---|---|---|---|---|
| C2 & LIGHTER | 1.7 | 2.5 | 3.0 | 2.1 |
| C3 & C4 (LPG) | 8.8 | 9.9 | 9.0 | 9.35 |
| GASOLINE | 44.0 | 46.1 | 45.0 | 45.05 |
| G + D | 63.0 | 65.6 | 63.0 | 64.3 |
| MCB | 20.0 | 15.5 | 18.5 | 17.75 |
| COKE | 6.5 | 6.5 | 6.5 | 6.5 |
| $C3^{=}$ & $C4^{=}$ | 5.0 | 7.6 | 7.0 | 6.3 |
| Regen. Temp, F. | 1360 | 1292 | 1478 | 1326 |
| FEED RATE MBPD | 20 | 12 | 20 | 16 |
| PRESSURE, PSIG | 35 | 35 | 75 | 35 |
| Water Quench wt % | -0- | 30 | 30 | 15 |

SIGNIFICANCE

Case A is the base case—no quench.

Case B (quenching w/ 30% water, constant pressure) gives a better yield than the base case, but there is a loss of plant capacity as much of the riser and downstream plant volume is taken up by steam. The feed rate must be reduced significantly.

Case C (quenching w/ 30% water—constant feed rate) shows how high the pressure has to be raised to permit the fresh feed rate to remain constant with this much quench. This would not be practical in most refineries; the air blower for the regenerator would usually not be able to generate these high pressures, and the downstream vessels and compressors would not usually be rated for these pressures. The yield pattern degrades because of the higher pressure operation.

These calculations show the side effects of operating with large amounts of water quench. Most units would not use this much water, but results with operating with lesser amounts of quench, e.g., around 10 to 15 wt % H2O are proportional. Operation with 15 wt % water quench gives benefits, and detriments, roughly in between the base case and Case B, and this is how Case D was estimated.

ILLUSTRATIVE EMBODIMENT (Invention)

A series of model calculations were run for a riser reactor cracking a sour gas oil, with 15% naphtha quench, at different elevations in the riser.

A commercial scale FCC riser reactor having a throughput of 80,000 BPD and having an initial diameter of about 3.5 feet, expanding to about 7.5 feet at the riser outlet, and an overall length of about 155 feet, was assumed for this exercise. The narrow portion of the riser, with a 3.5 ' diameter, would correspond to region 120 in the Figure, while the 7.5 ' diameter section would correspond to the top section of the riser 140. The superficial vapor velocity remains roughly constant throughout the riser. The total vapor residence time in the riser reactor was 4 seconds.

Feed properties of the sour gas oil and heavy naphtha are:

| | Fresh Feed | Heavy Naphtha |
|---|---|---|
| API | 22.5 | 19.4 |
| Basic N wt ppm | 425 | 50 |
| Total N, wt ppm | 1275 | 150 |
| UOP K | 11.6 | |
| Analine Pt | 165° F. | |
| Sulfur, wt % | 2.04 | |

-continued

| | Fresh Feed | Heavy Naphtha |
|---|---|---|
| D1160 DISTILLATION | | |
| 10% | 590° F. | 400° F. |
| 50% | 760° F. | 450° F. |
| 90% | 965° F. | 495° F. |

The catalyst was an equilibrium catalyst having 66 FAI and a 66 MAT activity. The conversion of the heavy feed was studied with several different quench points. The base case was operation with no quench. In addition, quenching at different elevations in the riser, corresponding to quench points before and after 1 second of residence time, were studied. Addition of this naphtha in an amount equal to 15 wt % of the heavy feed would reduce temperature in the riser, or quench the riser, by 17° F. (10° C.). The total vapor residence time in the riser was almost 4 seconds.

As used here, volume percent conversion of an FCC feedstock is defined as follows:

$$\text{Conversion}=100-(HFO+LFO)$$

where:

HFO=Vol % Heavy Fuel Oil

LFO=Vol % Light Fuel Oil

The results are plotted in FIG. 2.

ILLUSTRATIVE EMBODIMENT II (INVENTION)

Further model calculations, variations on the first Illustrative Embodiment, were made to study the effect of quenching at various residence times and with varying amounts of heavy naphtha quench. The quench location is specified in seconds of vapor residence time. Only the gasoline yields are reported.

| Quench Time (seconds) | wt % Heavy Naphtha | Quench delta T | Gasoline WT % | Yields: LV % |
|---|---|---|---|---|
| NONE | — | — | 45.8 | 55.5 |
| 0.2 s | 15 | 17° F. | 47.1 | 57.0 |
| 0.5 s | 15 | 17° F. | 47.2 | 57.1 |
| 2.2 s | 15 | 17° F. | 47.6 | 57.7 |
| 2.2 s | 12 | 14° F. | 47.3 | 57.3 |
| 2.2 s | 10 | 12° F. | 47.1 | 57.0 |
| 2.2 s | 8 | 10° F. | 46.9 | 56.8 |
| 2.2 s | 5 | 6° F. | 46.5 | 56.3 |

DISCUSSION

The process of the present invention calls for an unusual operation of the FCC unit. Based on the state of the art, quenching should only be beneficial when large amounts of quench are used, and when quenching occurs within a second of vapor residence time. In contrast, we found that quenching after 1 second of vapor residence time is better than quenching within 1 second. Alternatively, we could use less quench, later in the riser, to achieve results roughly equivalent to conventional approaches to quench but with only a fraction of the amount of quench fluid used.

The model calculations show that for relatively large amounts of quench, 15.0 wt % heavy naphtha, the optimum quench location was at 2.2 seconds of residence time in the riser.

The model calculations also show that use of 10.0 wt % heavy naphtha quench, at 2.2 seconds of residence time, was equivalent to use of 50% more quench within 0.2 seconds of residence time. Clearly this would put less load on the air blower and main column.

Use of only modest amounts of quench, e.g., just 5 wt %, past the mid point of the riser, significantly improves gasoline yields over the base case but adds much less heavy naphtha, to much less of the riser, as compared to the prior art practice of adding quench near the base of the riser.

Accordingly, the process of the present invention gives refiners great flexibility in improving the operation of their FCC units. Units able to tolerate large amounts of quench fluid can significantly increase conversion and improve yield of gasoline. Units which are constrained by their ability to tolerate quench may, by delayed quenching, achieve the higher conversions characteristic of quenching with larger amounts of quench within one second of riser vapor residence time.

Although described herein in conjunction with riser reactors, the process also works with equal effectiveness in a downflow reactor.

Addition of large amounts of a vaporizable quench fluid, more than halfway through the riser, will also improve the cracking process by providing a substantial increase in superficial vapor velocity at the point of injection. The increased vapor velocity will reduce catalyst slip, and promote rapid removal of both spent catalyst and cracked products from the riser. Near the end of the riser, e.g., about ¾ of the way through the cracking reactor, the catalyst has little activity, and functions more as a coke sink than as catalyst. Our model calculations accounted for this reduced catalyst residence time.

EJECTORS

Our model calculations do not reflect all the benefits that can be received in the commercial practice of our invention. We add extra fluid to the riser, but without increasing riser pressure as much as would be expected, by using aspirating nozzles, which function as steam-jet ejectors or eductors near the top of the riser.

Steam-jet ejectors are a simplified type of vacuum pump or compressor with no moving parts. They are commonly used in refineries and extensively discussed in *Perry's Chemical Engineer's Handbook*, Sixth Edition, Sections 6–31 to 6–35 of which are incorporated herein by reference.

We realized that our quench nozzles, especially when injecting steam or a steam/water mixture at some pressure, could lift or drive the riser contents toward the outlet much as steam jet ejectors.

The performance of any ejector is a function of the area of the steam nozzles, the physical properties of the fluids involved, and the ratio of suction and discharge pressures.

For maximum effect, we prefer to use a design similar to that of FIG. 6–7, Booster Ejector with multiple steam nozzles, and a venturi throat. Although FIG. 1 shows a venturi throat, it is possible, with degradation in ejector performance, to operate without a venturi section. We can even use conventional riser expansion, and/or use the natural flow patterns in the top of the riser to create, mechanically and/or hydraulically, something approaching a venturi shape. The hydraulic benefits of quench injection will be reviewed first.

By using multiple quench nozzles, at least 6 or 8 radially distributed nozzles having outlets near the vertical walls of the riser reactor, we can educt significant amounts of spent catalyst, which collects near the walls of the riser and drive it into the mainstream of flow through the riser. By proper selection of angle, we can scrape or educt from the walls of the riser much of the annular layer of catalyst which forms there, creating a riser of enlarged cross sectional area at or slightly above the nozzle outlets. The effective diameter of the riser will approach that of the ID of the riser, rather than the ID of the riser plus the annular layer of catalyst. This enlarged section may roughly correspond to the converging section of the venturi.

The venturi throat can be formed by pointing the nozzles, or each layer of nozzles if 2 or more rings of nozzles are used, at a converging point 0.5 to 2.5 riser diameters downstream. Something like a venturi shape, or type of vena contracta, can form from hydraulic forces. The throat of the venturi will be the converging point.

The diverging section of the venturi, an enlarged section, will form downstream of the converging point. The hydraulic diameter of the riser is slightly increased by blowing away some of the annular layer of catalyst on the walls of the riser using the quench nozzle discharge blast.

A mechanical approximation of a venturi section can be achieved by placing the nozzles at, or just below or even slightly above, a location in the riser where the riser diameter increases. This uses the conventional riser configuration, with an increased diameter to allow for molar expansion, to approximate a venturi, at least the expansion section of the venturi.

For a vertical riser reactor, the quench nozzles should be aimed at a point on a centerline of the vertical riser reactor, at an angle ranging from 30 to approaching 90° from horizontal, and preferably at an angle ranging from 45 to 80° from horizontal.

Alternatively, one or preferably a plurality of quench nozzles pointing downstream to the riser outlet may be used to quench and simultaneously achieve some eduction effect.

Preferably the quench fluid is steam or a vaporizable liquid added via atomizing feed nozzles added in a way so that the maximum eductor effect is achieved. The simplest way to implement this is to point the nozzles in a downstream direction relative to fluid flow in said riser. This will usually not be the quickest way to quench the fluid in the riser, perpendicular or countercurrent injection of quench fluid would probably be most effective from an instantaneous quench standpoint. Cross-flow, or countercurrent quench injection, will also increase riser pressure more, which increased pressure hurts gasoline yields.

We prefer to inject quench fluid so that it tends to aspirate the riser contents towards the riser outlet. This can reduce pressure drop through the riser and prevent or at least reduce catalyst reflux near the riser outlet.

Aspirating or educting quench works especially well when relatively high nozzle exit velocities are used, preferably in excess of 100 fps, and most preferably in excess of 200 fps. This allows some useful work to be performed by the quench fluid, in reducing overall riser pressure, riser pressure drop, and catalyst residence time.

EDUCTOR CALCULATION

The following calculation is based on the the method shown in Perry's handbook and assumes the riser and nozzles act like a well-designed eductor. In an actual FCC unit this will probably not be the case. The calculation shows directionally the benefit that can be achieved with educting quench. The basis for the calculations is:

FCC riser reactor of 2 ft diameter, operating at 20 psig;

12 quench nozzles, each with a 2 square inch outlet cross section; and 16 wt % dispersion steam, at 175 psig.

Such an eductor will cause a 3.5 psi pressure difference across the eductor. That portion of the riser reactor upstream of the eductor can operate at a pressure 3.5 psi lower than that portion of the riser, and plant, downstream of the eductor. This will increase somewhat yields of gasoline.

This calculation does not consider post-riser effects of this amount of steam injection. Injection of such large amounts of steam will increase plant pressure, but at least in the base of the riser the effect of steam injection will be to reduce, rather than increase, pressure.

When high pressure steam is discharged through some nozzles, discharge velocities can approach sonic velocity, which can attrit catalyst, so harder catalyst may be used, or increased catalyst makeup rates expected.

Whether or not any useful work is performed by the quench fluid, there will be an increased gasoline yield from the practice of the present invention in almost all instances.

Most of the increase in gasoline yield is due to enhanced catalytic activity in a majority of the riser, and suppressed thermal cracking in at least the last half of the vapor residence time in the riser.

What we claim is:

1. In a catalytic cracking process wherein a feed comprising non-distillable hydrocarbons is catalytically cracked in a riser reaction zone, operating at riser cracking conditions, including a riser vapor residence time, by contact with a source of hot, regenerated cracking catalyst to produce catalytically cracked vapors and spent cracking catalyst, cracked vapors are withdrawn as products, and spent cracking catalyst is regenerated in a catalyst regeneration means to produce hot regenerated cracking catalyst which is recycled to contact said feed, the improvement comprising:

cracking in the base of a vertical riser reactor having a length, for at least 1 second of vapor residence time and for at least the first 50% of the length of the riser reactor from the base, a heavy feed containing at least 10 wt % non-distillable hydrocarbons by contact with hot regenerated cracking catalyst at a cat:feed weight ratio of a least 4:1 and wherein the amount and temperature of the hot regenerated catalyst are sufficient to produce a catalyst feed mixture temperature sufficient to promote both catalytic cracking and undesired thermal cracking of said feed in said riser; and quenching, after at least 1 second of vapor residence time, said catalyst mixture in a quench zone within said riser reactor by injecting, within the first 80% of the length of the riser reactor from the base, an inert quench fluid in an amount sufficient to quench the temperature in the riser at least 5° F.;

wherein said riser reactor has a centerline, said quench fluid is steam or a vaporizable liquid added under pressure via atomizing quench nozzles pointing toward the centerline of said riser and in a downstream direction relative to fluid flow in said riser, and said nozzles have a nozzle discharge velocity, of at least 200 fps and aspirate or educt the contents of the riser toward the riser outlet.

2. A method of increasing gasoline yields during riser catalytic cracking comprising:

adding to the base of a riser cracking reactor a preheated, hydrocarbon feed comprising 650° F.+hydrocarbons and a supply of hot regenerated cracking catalyst, to form a mixture of feed and catalyst having a mix temperature above about 1020° F. and sufficient to vaporize said feed and promote catalytic cracking and undesired thermal cracking reactions:

cracking, at high temperature, catalytic cracking conditions, said feed for at least 1.0 seconds of vapor residence time to produce catalyst having a reduced catalytic activity and partially cracked products having a temperature sufficient to cause undesired thermal reactions;

quenching said high temperature intermediate product in a quench zone by injecting within 80% of the riser length an inert quench fluid in an amount sufficient to quench the temperature in the riser at least 7.5° F.;

quenched cracking of said quenched intermediate product for a vapor residence time of at least 0.1 seconds, and wherein the post quench vapor residence time in said riser reactor is less than the vapor residence time in said high temperature cracking zone;

discharging from said riser reactor a mixture of cracked vapors comprising gasoline boiling range hydrocarbons and spent catalyst and separating to form a cracked vapor phase and a spent catalyst phase;

stripping said spent catalyst to produce stripped catalyst;

regenerating said stripped catalyst to produce a supply of hot regenerated catalyst and recycling said hot regenerated catalyst to said cracking reactor; and fractionating said cracked vapor phase to produce a gasoline boiling range product fraction, wherein said gasoline product fraction is larger in volume than a gasoline product fraction obtainable when an identical amount of quench fluid is charged to said cracking reactor within 50% of the riser length in said high temperature cracking zone upstream of quench injection; and wherein the quench fluid is added via a plurality of radially distributed spray nozzles, and discharged with an exit velocity sufficient to reduce the pressure upstream of the quench point by at least 0.5 psia, and reduce the pressure at the base of the riser reactor at least 0.5 psia, and increase gasoline selectivity in said riser reactor.

3. The process of claim 2 wherein said quench fluid is steam or a vaporizable liquid added via atomizing feed nozzles pointing in a downstream direction relative to fluid flow in said riser, and said nozzles have a nozzle discharge velocity of at least 200 fps.

4. The process of claim 3 wherein said quench fluid is steam or a vaporizable liquid added via atomizing feed nozzles pointing in a downstream direction relative to fluid flow in said riser, said nozzles have a nozzle discharge velocity of at least 200 fps.

5. A process for the quenched, reduced pressure, riser catalytic cracking of a hydrocarbon feed to lighter products comprising:

adding to the base of a riser cracking reactor a feed comprising 650° F.+hydrocarbons and a supply of hot regenerated cracking catalyst, to form a mixture of feed and catalyst having a mix temperature above about 1000° F.

catalytically cracking said feed at a riser base pressure of 15 to 50 psia to produce a high temperature partially cracked product and catalyst passing as dilute phase up said riser;

quenching and educting said dilute phase by injecting into the riser via quench nozzle water, steam, or hydrocarbons boiling below the gas oil range or mixtures thereof, and wherein the quench nozzles are radially distributed around the riser, and point toward a centerline of the riser and in the direction of the riser outlet, the pressure and amount of injected fluid, and the nozzle configuration and alignment, are sufficient to educt or aspirate the dilute phase material in the riser toward the riser outlet, and wherein the pressure in the base of the riser is at least 1.0 psi less than the pressure in the base of the riser which would be measured by injecting the same amount of fluid horizontally into the riser;

discharging a mixture of cracked vapors comprising gasoline boiling range hydrocarbons and spent catalyst from said riser reactor;

stripping said spent catalyst to produce stripped catalyst;

regenerating said stripped catalyst to produce a supply of hot regenerated catalyst and recycling said hot regenerated catalyst to said cracking reactor; and fractionating said cracked vapors to produce a gasoline boiling range product fraction.

* * * * *